US005344019A

United States Patent [19]

Van Hest

[11] Patent Number: 5,344,019

[45] Date of Patent: Sep. 6, 1994

[54] TRAY FROM FOLDED SHEET MATERIAL AND BLANK FOR THIS TRAY

[75] Inventor: Wilhelmus J. J. Van Hest, Eindhoven, Netherlands

[73] Assignee: U.S. Philips Corporation, New York, N.Y.

[21] Appl. No.: 8,115

[22] Filed: Jan. 25, 1993

[30] Foreign Application Priority Data

Feb. 19, 1992 [EP] European Pat. Off. ..... 92200481.7

[51] Int. Cl.[5] ..... B65D 85/42

[52] U.S. Cl. ..... 206/485; 206/419

[58] Field of Search ..... 206/418, 419, 485, 438, 206/526, 538

[56] References Cited

U.S. PATENT DOCUMENTS

| | | | |
|---|---|---|---|
| 2,951,583 | 9/1960 | Sanford | 206/419 |
| 4,385,694 | 5/1983 | Klomp | 206/418 |
| 4,498,580 | 2/1985 | Getz et al. | 206/418 |
| 4,561,542 | 12/1985 | Przeplora | 206/418 |
| 4,951,813 | 8/1990 | Sauter | 206/45.19 |
| 5,038,939 | 8/1991 | Van Hest | 206/583 |
| 5,048,676 | 9/1991 | Borgis et al. | 206/45.15 |

FOREIGN PATENT DOCUMENTS

| | | | |
|---|---|---|---|
| 839623 | 5/1952 | Fed. Rep. of Germany . | |
| 1201650 | 1/1960 | France . | |
| 0448877 | 5/1949 | Italy | 206/485 |
| 0454136 | 1/1950 | Italy | 206/485 |

*Primary Examiner*—Jimmy G. Foster

*Attorney, Agent, or Firm*—Ernestine C. Bartlett

[57] ABSTRACT

The tray and the blank from sheet material comprise a rectangular base portion (1) having first (2, 4) and second (3, 5) opposing edges. First walls (12, 14) extend along and remote from the first edges and comprise opposing openings (112, 114) for accommodating a respective end portion of a body. Buffering bands (22, 24; 32, 34) are present at the first walls adjacent (22, 24) as well as remote (32, 34) from the base portion (1). Second walls (13, 15) are present along the second edges (3, 5), each connected to the remote buffering bands (32, 34). The base portion (1) is connected to one second wall (13) and coupled to the other second wall (15). The tray can be formed from the blank without auxiliary means. The tray and bodies, e.g. fluorescent lamps, accommodated therein can be handled without additional support.

15 Claims, 2 Drawing Sheets

TRAY FROM FOLDED SHEET MATERIAL AND BLANK FOR THIS TRAY

The invention relates to a tray made of folded sheet material for accommodating several elongate objects arranged next to one another, comprising:

a rectangular base portion having first and second mutually opposing edges;

first walls extending along and remote from the first edges and resting on the base portion, which walls are provided with mutually opposing openings for accommodating respective end portions of an object in each pair of opposing openings;

adjacent and remote buffering bands at the first walls which extend adjacent and remote from the base portion, respectively, and parallel thereto, and which are integral with the corresponding first walls.

The invention also relates to a blank for this tray.

Such a tray is known from FR-1 201 650.

The known tray is obtained in that a rectangular piece of cardboard is folded at two mutually opposing edges about mutually parallel folding lines, so that a plate having two opposing hollow tubes is created. The openings are present in mutually facing surfaces of these tubes, and objects can be accommodated with their ends in these openings.

A disadvantage of the known tray is its poor stiffness. The tray must be securely supported in order to retain its grip on the objects accommodated therein. According to the cited Patent, the tray does not attain shape permanency until it is stacked together with similar trays in an outer box.

Another disadvantage of the known tray is that it is only suitable for protecting objects which have sudden transitions in their lateral dimensions. As a result of this, the objects may be accommodated in an opening with an end portion of small lateral dimensions, while an adjoining portion having greater lateral dimensions butts against the tube next to the opening. An object which does not have any transition in lateral dimensions may support itself against the inside of the tube with one end, so that it is only buffered by the thickness of the tube wall. The risk of damage or fracture of the object is great then if this tube wall is hit by an impact.

DE-839 623 discloses a cardboard box for packing ampoules. There are also tubular walls with openings at two opposing sides at the base of this box. At the remaining sides there are walls which can be folded upwards, one of which is connected to a lid provided with a closing flap.

The box has only a poor stiffness, so that it is recommended to pass it into a sleeve while open and to close the lid over the sleeve. If the closed box is not very stiff to begin with, the open box is even weaker and cannot be handled without support if it is to be prevented that the objects drop out. The box also has the disadvantage that it insufficiently protects objects without transitions in lateral dimensions.

It is an object of the invention to provide a tray of the kind mentioned in the opening paragraph which has a high degree of stiffness. Another object is to provide such a tray which in addition affords protection to objects which have no transitions in lateral dimensions at at least one end portion.

According to the invention, this object is achieved in that second walls are present along the second edges, which second walls rest on the base portion and are each connected to the remote buffering bands, and the base portion is connected to one of the second walls and is coupled to the other second wall.

The tray has a great shape permanency so that it can be easily handled with objects accommodated therein, for example, electric lamps. The tray owes its shape permanency on the one hand to the second walls and their connection to the remote buffering bands, and on the other hand to the base portion which is connected and coupled to the second walls. The tray as a result has a sandwich structure with a first layer in the base portion and a second layer in the remote buffering bands, which layers are spaced apart by the mutually transverse first and second walls. Deformations parallel to the base portion are counteracted by the remote buffering bands coupled by the second walls.

In a special embodiment, the tray may be built up from a single blank.

In a favourable embodiment, a blind wall is present between a first edge and the adjacent upright first wall, at a distance from the latter two. The blind wall prevents objects to be accommodated from moving too far through the openings in the first wall and, for example, projecting outside the tray.

The blind wall may be a separate body which is provided in the tray. In that case the blind wall may be connected to buffering bands of its own, for example, such bands lying adjacent and remote from the base portion, respectively.

In a favourable embodiment, however, the remote buffering band of the blind wall is connected to the remote buffering band of the corresponding first wall. This embodiment has the advantage that the blind wall and its buffering bands can be integral with the other portions of the tray.

It is favourable if openings are present in the second walls, into which openings tags are inserted, fixing the first walls. These tags may be present at the first walls themselves, or alternatively at the adjacent buffering bands of these walls, or at both.

The base portion may be coupled by means of, for example, staples, tape or glue to the other second wall than the one to which it is connected. A stapled coupling, for example, is convenient.

In a favourable embodiment, however, the second wall to which the base portion is coupled comprises an auxiliary strip provided with an incision. The base portion may then have a closing flap which projects through this incision to the inside. This embodiment has the advantage that a tray formed from a single blank can be put together and given a permanent shape entirely without adhesion aids such as glue, tape, staples, etc.

Depending on the requirements of the objects to be accommodated, the tray may be manufactured from, for example, duplex or triplex cardboard, corrugated paperboard, or mini corrugated paperboard. The tray has the advantage that it need not be put together from flat sheet material cut into shape and provided with folding creases until the moment at which it is actually needed. In contrast to conventional trays or buffers made of synthetic materials such as PVC or polystyrene foam, the tray has a very small volume until the moment the objects are accommodated. But also with objects inside, the tray can achieve a very great volume saving, for example of tens of percents, for example 75%, if polystyrene foam is dispensed with. Added to this is the greater tensional and bending strength of sheet material such as cardboard. Cardboard in addition has the advantage that it can be recycled, for example, together with paper.

An embodiment of the tray according to the invention is shown in the drawings, in which FIG. 1 shows a tray in perspective view;

Figure 1:
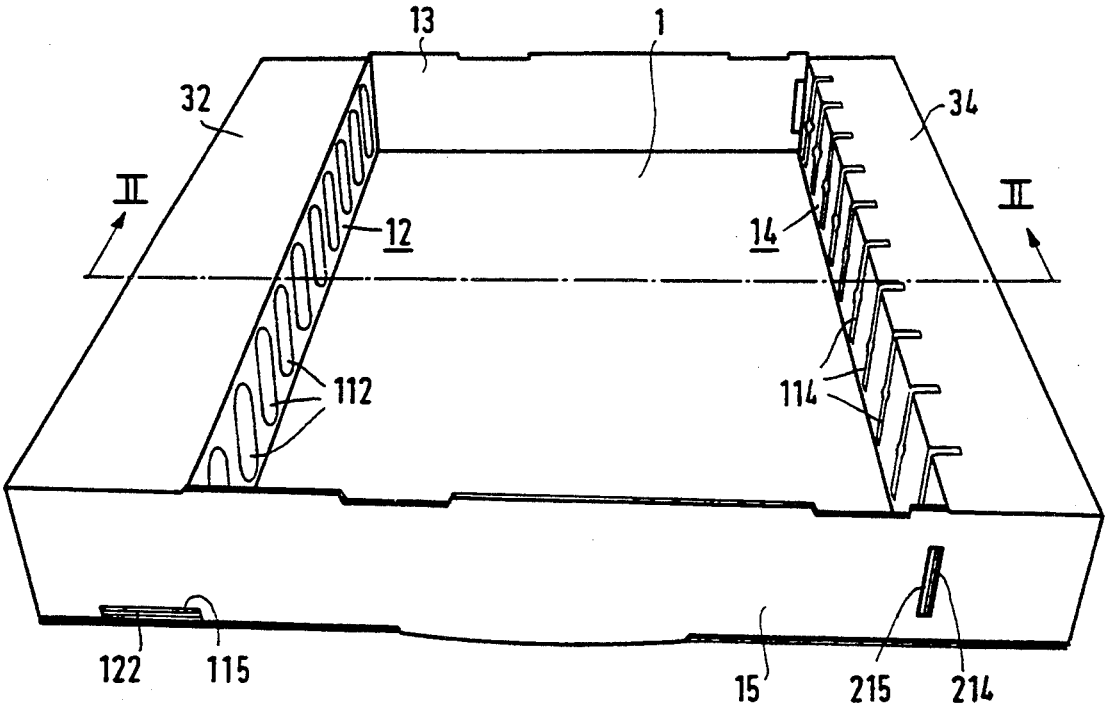
Figure 2:
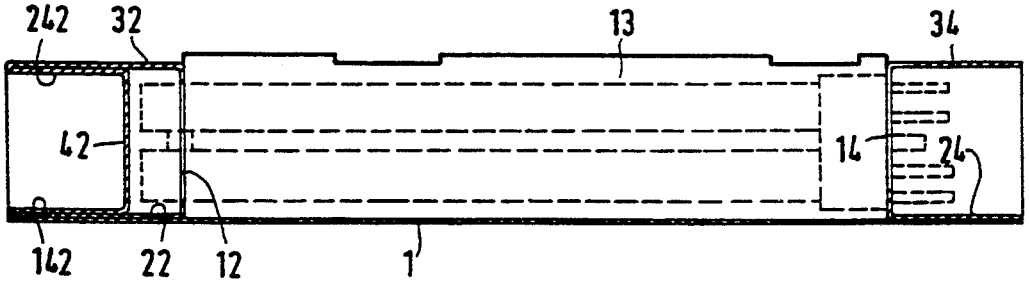
FIG. 2 is a cross-section taken on the line II—II in FIG. 1.

In the Figures, the tray of folded sheet material for accommodating several elongate objects next to one another comprises a rectangular base portion 1 with first 2, 4 and with second 3, 5 mutually opposing edges. First walls 12, 14 resting on the base portion extend along and remote from the first edges 2, 4, which walls are provided with mutually opposing openings 112 and 114. The openings serve to accommodate respective end portions of an object in each pair of opposing openings 112, 114. The first walls 12, 14 comprise adjacent and remote buffering bands 22, 24; 32, 34 which extend adjacent 22, 24 and remote from 32, 34 the base portion 1, respectively, and parallel thereto, and which are integral with the corresponding first walls 12, 14.

Second walls 13, 15 rest on the base portion 1 along the second edges 3, 5, which walls are each connected to the remote buffering bands 32, 34. The base portion 1 is connected to one 13 of the second walls 13, 15 and coupled to the other second wall 15.

A blind wall 42 is present between a first edge 2 and the adjacent first wall 12, at a distance from the latter two.

The blind wall 42 is connected to its own buffering bands 142,242, which are situated near 142 and remote from 242 the base portion 1, respectively.

The remote buffering band 242 of the blind wall 42 is connected to the remote buffering band 32 of the corresponding first wall 12.

The second walls 13, 15 comprise openings 113,213; 115,215 into which respective tags 122, 214 project, fixing the first walls 12, 14.

The base portion 1 has a closing flap 6 which projects into an incision 125 in an auxiliary strip 25, which closing flap is present at the other second wall 15 than the one to which the base portion 1 is connected. A convenient coupling to this other second wall is obtained in this way.

The tray and blank shown are formed from mini corrugated cardboard. The direction in which crests and troughs of the corrugations extend is shown in a broken-away portion in FIG. 3.

The tray is designed for accommodating fluorescent lamps having lamp caps at one end and having two straight tube portions running in parallel. Contact pins of the lamp cap may be accommodated in an opening 114, while the free ends of the tube portions are accommodated in an opposing opening 112. The blind wall 42 prevents shifting of the lamp and protects it from axial impacts.

Figure 3:
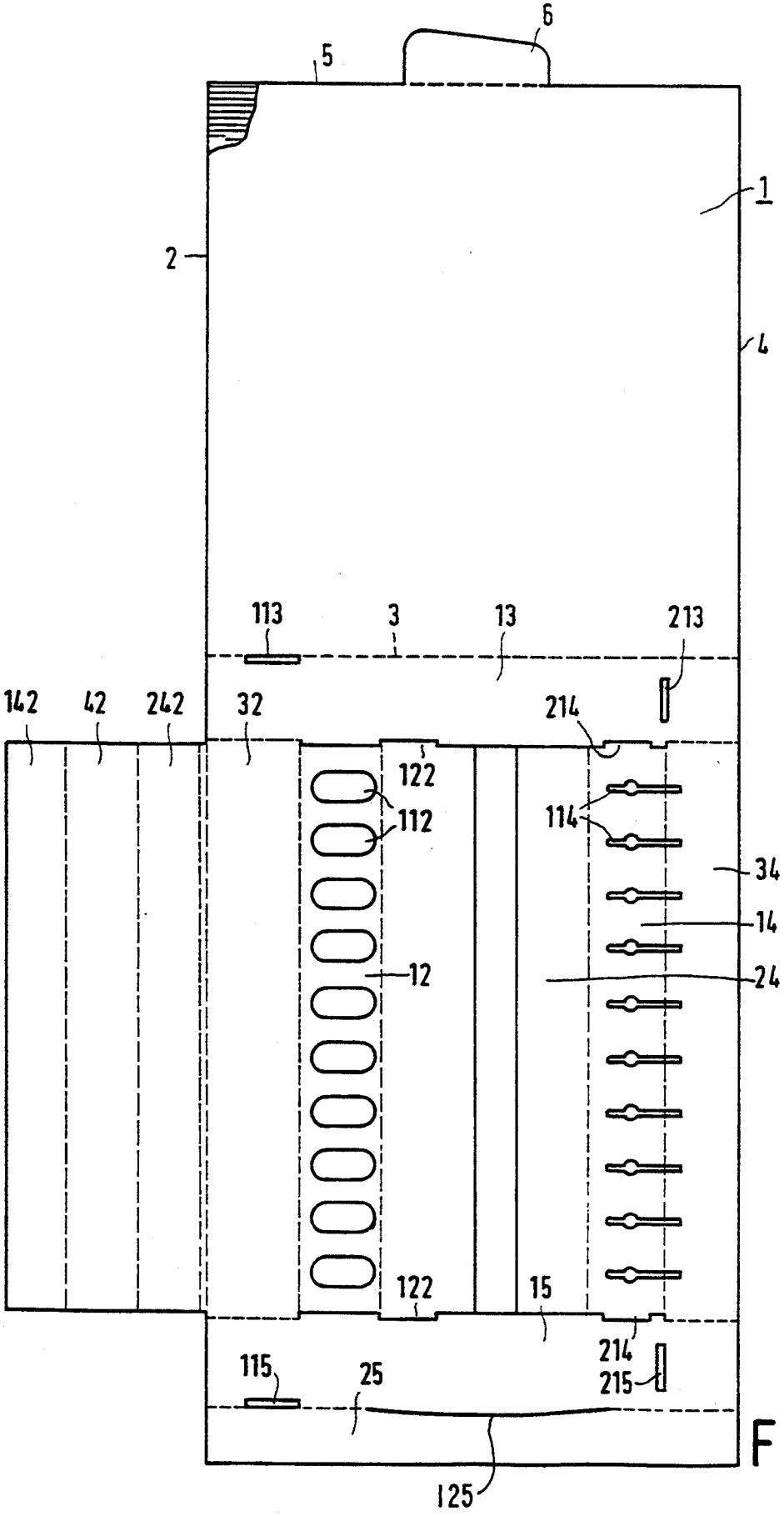
FIG. 3 is a collapsed sheet (blank) for the tray of FIG. 1.

The blank of FIG. 3 shows that when two integral blanks are cut out mutually reversed, a very small loss of material is endured.

The tray shown may be readily filled with ten lamps and handled with one hand without additional support. Stacked in an outer box, the tray affords sufficient protection to the lamps in the severest standard impact and drop tests.

I claim:

1. A tray mode of folded sheet material for accommodating several elongate objects arranged next to one another, comprising:

a rectangular base portion having a first set of two mutually opposing edges and a second set of mutually opposing edges, two first walls, positioned remote from said first set of mutually opposing edges, each of said first walls resting on said base portion and extending in a direction parallel to the axis of said first set of mutually opposing edges, each of said first walls being provided with mutually opposing openings adapted for accommodating respective end portions of each of said objects, first and second sets of two buffering bands each, each band in said first set of buffering bands integral with one of said first walls and extending outwardly from said base portion in a direction parallel thereto, one of said bands of said first set of buffering bands positioned adjacent to said base portion and the other of said bands of said first set of buffering bands positioned remote from said base portion, each band in said second set of buffering bands integral with the other of said first walls and extending outwardly from said base portion in a direction parallel thereto, one of said bands in said second set of buffering bands being positioned adjacent to said base portion and the other of said bands of said second set of buffering bands positioned remote from said base portion;

characterized in that:

two second walls are present each positioned along one of the edges of said second set of edges, each resting on said base portion and each connected to a separate one of said remote buffering bands and the base portion is connected to both of said second walls.

2. A tray as claimed in claim 1, characterized in that the tray is made from one integral piece of sheet material.

3. A tray as claimed in claim 1, characterized in that a blind wall extending in a direction parallel to one of said two first walls is positioned between said one of said two first walls and an edge of said first group of edges and relatively closer to said one of said two first walls then to said other edge of said first group of edges.

4. A tray as claimed in claim 3 wherein the tray is made from one integral piece of sheet material.

5. A tray of claim 3 characterized in that the first wall is connected to a third set of buffering bands extending outwardly from said blind wall, one of said bands of said third set being positioned adjacent to said base portion and the other of said bands of said third set being positioned remote from said base portion.

6. A tray as claimed in claim 5 wherein the tray is made from one integral piece of sheet material.

7. The tray as claimed in claim 5, characterized in that the band of said third set of bands positioned remote from said base portion is connected to the buffering band of said one of said first walls positioned remote from said base portion.

8. A tray as claimed in claim 7 wherein the tray is made from one integral piece of sheet material.

9. A tray as claimed in claim 1, characterized in that an opening is present in each of said second walls and a tag is present in each of said first walls, each of said tags being inserted into one of said openings thereby connecting said first walls to said second walls.

10. A tray as claimed in claim 9 wherein the tray is made from one integral piece of sheet material.

11. A tray as claimed in claim 1, characterized in that one of said second walls comprises an auxiliary strip provided with an incision into while incision a closing flap extending from the base portion projects to the inside of said tray.

12. A tray as claimed in claim 11 wherein the tray is made from one integral piece of sheet material.

13. A blank of sheet material having a profile, openings and slits positioned in a manner such that said blank is suitable for folding to form a tray for accommodating several elongate objects arranged next to one another:

said array comprising:

a rectangular base portion having a first set of two mutually opposing edges and a second set of mutually opposing edges, two first walls, positioned remote from said first set of mutually opposing edges, each of said first walls resting on said base portion and extending in a direction parallel to the axis of said first set of mutually opposing edges, each of said first walls being provided with mutually opposing openings adapted for accommodating respective end portions of each of said objects, first and second sets of two buffering bands each, each band in said first set of buffering bands integral with one of said first walls and extending outwardly from said base portion in a direction parallel thereto, one of said bands of said first set of buffering bands positioned adjacent to said base portion and the other of said bands of said first set of buffering bands positioned remote from said base portion, each band in said second set of buffering bands integral with the other of said first walls and extending outwardly from said base portion in a direction parallel thereto one of said bands in said second set of buffering bands being positioned adjacent to said base portion and the other of said bands of said second set of buffering bands positioned remote from said base portion;

characterized in that:

two second walls are present each positioned along one of the edges of said second set of edges, each resting on said base portion and each connected to a separate one of said remote buffering bands and the base portion is connected to both of said second walls.

14. A blank as claimed in claim 13, characterized in that a blind wall extending in a direction parallel to one of said two first walls is positioned between said one of said two first walls and an edge of said first group of edges relatively closer to said one of said two first walls then to said other edge of said first group of edges.

15. A blank as claimed in claim 13, characterized in that the first wall is connected to a third set of buffering bands extending outwardly from said blind wall, one of said bands of said third set being positioned adjacent to said base portion and the other of said bands of said third set being positioned remote from said base portion.

* * * * *